US008019479B2

(12) United States Patent
Stiles et al.

(10) Patent No.: US 8,019,479 B2
(45) Date of Patent: Sep. 13, 2011

(54) CONTROL ALGORITHM OF VARIABLE SPEED PUMPING SYSTEM

(75) Inventors: Robert W. Stiles, Holly Springs, NC (US); Lars Hoffmann Berthelsen, Randers (DK); Ronald B. Robol, Sanford, NC (US); Christopher R. Yahnker, Raliegh, NC (US); Everett Cox, Sanford, NC (US); Donald Steen, Sanford, NC (US); Kevin Murphy, Quartz Hill, CA (US); Walter J. Woodcock, Jr., Sanford, NC (US); Daniel J. Hruby, Sanford, NC (US); Peter Westermann-Rasmussen, Soenderborg (DK); Gert Kjaer, Soenderborg (DK); Einar Kjartan Runarsson, Soenderborg (DK); Arne Fink Hansen, Graasten (DK); Alberto Morando, Soenderborg (DK); Florin Lungeanu, Graasten (DK); Nils-Ole Harvest, Nordborg (DK)

(73) Assignee: Pentair Water Pool and Spa, Inc., Sanford, NC (US)

( * ) Notice: Subject to any disclaimer, the term of this patent is extended or adjusted under 35 U.S.C. 154(b) by 1541 days.

(21) Appl. No.: 11/286,888

(22) Filed: Nov. 23, 2005

(65) Prior Publication Data

US 2007/0114162 A1 May 24, 2007

Related U.S. Application Data

(63) Continuation-in-part of application No. 10/926,513, filed on Aug. 26, 2004, now Pat. No. 7,874,808.

(51) Int. Cl.
*G05D 9/12* (2006.01)
*F04B 49/00* (2006.01)

(52) U.S. Cl. ..... 700/282; 134/6; 210/739; 417/42; 417/43; 417/44.1; 417/53

(58) Field of Classification Search ..... 700/282; 417/42, 43, 44.1, 53; 134/6; 210/739; 340/825.69
See application file for complete search history.

(56) References Cited

U.S. PATENT DOCUMENTS 3,613,805 A 10/1971 Linstad (Continued)

FOREIGN PATENT DOCUMENTS

DE 19645129 5/1998

(Continued)

OTHER PUBLICATIONS

"Better, Stronger, Faster;" Pool & Spa News, Sep. 3, 2004; pp. 52-54, 82-84, USA.

*Primary Examiner* — Albert Decady
*Assistant Examiner* — Douglas S Lee
(74) *Attorney, Agent, or Firm* — Quartes & Brady LLP

(57) ABSTRACT

A pumping system includes a pump for moving water. In one aspect, this is in connection with performance of an operation. The system includes a variable speed motor operatively connected to drive the pump. A value indicative of flow rate of water is determined and the motor is controlled to adjust the flow rate indicative value toward a constant. A value indicative of flow pressure is determined and the motor is controlled to adjust the flow pressure indicative value toward a constant. A selection is made between flow rate control and flow pressure control. In another aspect, the pump is controlled to perform a first operation, and is operated to perform a second water operation. Control of operation of the pump to perform the first water operation is altered in response to operation of the pump to perform the second operation.

16 Claims, 10 Drawing Sheets

U.S. PATENT DOCUMENTS

| | | | | |
|---|---|---|---|---|
| 3,778,804 | A | 12/1973 | Adair | |
| 3,787,882 | A | 1/1974 | Fillmore | |
| 4,353,220 | A | 10/1982 | Curwen | |
| 4,494,180 | A | 1/1985 | Streater | |
| 4,610,605 | A | 9/1986 | Hartley | |
| 4,678,409 | A | 7/1987 | Kurokawa | |
| 4,703,387 | A | 10/1987 | Miller | |
| 4,767,280 | A | 8/1988 | Markuson | |
| 4,795,314 | A | 1/1989 | Prybella | |
| 4,834,624 | A | 5/1989 | Jensen | |
| 4,912,936 | A | 4/1990 | Denpou | |
| 4,963,778 | A | 10/1990 | Jensen et al. | |
| 5,026,256 | A | 6/1991 | Kuwabara | |
| 5,099,181 | A | 3/1992 | Canon | |
| 5,117,233 | A * | 5/1992 | Hamos et al. | 340/825.69 |
| 5,123,080 | A | 6/1992 | Gillett | |
| 5,156,535 | A | 10/1992 | Burdis | |
| 5,158,436 | A | 10/1992 | Jensen | |
| 5,167,041 | A | 12/1992 | Burkitt | |
| 5,240,380 | A | 8/1993 | Mabe | |
| 5,342,176 | A | 8/1994 | Redlich | |
| 5,471,125 | A | 11/1995 | Wu | |
| 5,512,883 | A | 4/1996 | Lane | |
| 5,518,371 | A | 5/1996 | Wellstein | |
| 5,519,848 | A | 5/1996 | Wloka | |
| 5,520,517 | A * | 5/1996 | Sipin | 417/44.3 |
| 5,571,000 | A | 11/1996 | Zimmermann | |
| 5,580,221 | A | 12/1996 | Triezenberg | |
| 5,598,080 | A | 1/1997 | Jensen | |
| 5,614,812 | A | 3/1997 | Wagoner | |
| 5,626,464 | A | 5/1997 | Schoenmyr | |
| 5,628,896 | A | 5/1997 | Klingenberger | |
| 5,711,483 | A | 1/1998 | Hays | |
| 5,727,933 | A | 3/1998 | Laskaris et al. | |
| 5,791,882 | A | 8/1998 | Stucker | |
| 5,804,080 | A * | 9/1998 | Klingenberger | 210/739 |
| 5,819,848 | A | 10/1998 | Rasmusson | |
| 5,883,489 | A | 3/1999 | Konrad | |
| 5,909,372 | A | 6/1999 | Thybo | |
| 5,941,690 | A | 8/1999 | Lin | |
| 5,969,958 | A | 10/1999 | Nielsen | |
| 5,973,465 | A | 10/1999 | Rayner | |
| 6,037,742 | A | 3/2000 | Rasmussen | |
| 6,046,492 | A | 4/2000 | Machida | |
| 6,048,183 | A | 4/2000 | Meza | |
| 6,072,291 | A | 6/2000 | Pedersen | |
| 6,091,604 | A | 7/2000 | Plougsgaard | |
| 6,102,665 | A | 8/2000 | Centers | |
| 6,125,481 | A | 10/2000 | Sicilano | |
| 6,142,741 | A | 11/2000 | Nishihata | |
| 6,208,112 | B1 | 3/2001 | Jensen | |
| 6,254,353 | B1 | 7/2001 | Polo | |
| 6,264,431 | B1 | 7/2001 | Triezenberg | |
| 6,299,414 | B1 | 10/2001 | Schoenmyr | |
| 6,299,699 | B1 * | 10/2001 | Porat et al. | 134/6 |
| 6,326,752 | B1 | 12/2001 | Jensen | |
| 6,351,359 | B1 | 2/2002 | Jaeger | |
| 6,354,805 | B1 | 3/2002 | Moller | |
| 6,373,728 | B1 | 4/2002 | Aarestrup | |
| 6,380,707 | B1 | 4/2002 | Rosholm | |
| 6,406,265 | B1 | 6/2002 | Hahn | |
| 6,416,295 | B1 | 7/2002 | Nagai | |
| 6,426,633 | B1 | 7/2002 | Thybo | |
| 6,450,771 | B1 | 9/2002 | Centers | |
| 6,464,464 | B2 | 10/2002 | Sabini | |
| 6,468,042 | B2 | 10/2002 | Moller | |
| 6,468,052 | B2 | 10/2002 | McKain et al. | |
| 6,474,949 | B1 | 11/2002 | Arai | |
| 6,481,973 | B1 | 11/2002 | Struthers | |
| 6,483,278 | B2 | 11/2002 | Harvest | |
| 6,548,976 | B2 | 4/2003 | Jensen | |
| 6,604,909 | B2 * | 8/2003 | Schoenmeyr | 417/32 |
| 6,623,245 | B2 | 9/2003 | Meza | |
| 6,676,831 | B2 | 1/2004 | Wolfe | |
| 6,690,250 | B2 | 2/2004 | Moller | |
| 6,715,996 | B2 | 4/2004 | Moeller | |
| 6,717,318 | B1 | 4/2004 | Mathiassen | |
| 6,747,367 | B2 | 6/2004 | Cline | |
| 6,774,664 | B2 | 8/2004 | Godbersen | |
| 6,925,823 | B2 | 8/2005 | Lifson | |
| 7,005,818 | B2 | 2/2006 | Jensen | |
| 7,050,278 | B2 | 5/2006 | Poulsen | |
| 7,083,392 | B2 | 8/2006 | Meza | |
| 7,221,121 | B2 | 5/2007 | Skaug | |
| 2001/0041139 | A1 | 11/2001 | Sabini et al. | |
| 2002/0050490 | A1 | 5/2002 | Pittman | |
| 2002/0070875 | A1 | 6/2002 | Crumb | |
| 2002/0136642 | A1 | 9/2002 | Moller | |
| 2003/0017055 | A1 | 1/2003 | Fong | |
| 2003/0099548 | A1 | 5/2003 | Meza | |
| 2003/0196942 | A1 * | 10/2003 | Jones | 210/169 |
| 2004/0009075 | A1 | 1/2004 | Meza | |
| 2004/0013531 | A1 | 1/2004 | Curry et al. | |
| 2005/0123408 | A1 * | 6/2005 | Koehl | 417/53 |
| 2005/0190094 | A1 | 9/2005 | Andersen | |
| 2005/0226731 | A1 | 10/2005 | Mehlhorn | |
| 2006/0045750 | A1 | 3/2006 | Stiles | |
| 2006/0090255 | A1 | 5/2006 | Cohen | |
| 2006/0127227 | A1 | 6/2006 | Mehlhorn | |
| 2007/0154319 | A1 | 7/2007 | Stiles | |
| 2007/0154320 | A1 | 7/2007 | Stiles | |
| 2007/0154321 | A1 | 7/2007 | Stiles | |
| 2007/0154322 | A1 | 7/2007 | Stiles | |
| 2007/0154323 | A1 | 7/2007 | Stiles | |
| 2007/0163929 | A1 | 7/2007 | Stiles | |
| 2007/0183902 | A1 | 8/2007 | Stiles | |

FOREIGN PATENT DOCUMENTS

| | | |
|---|---|---|
| DE | EP 0 916 026 B1 | 2/2002 |
| DE | 10231773 | 2/2004 |
| DE | 19938490 | 4/2005 |
| EP | 0314249 | 5/1989 |
| EP | 0709575 | 5/1996 |
| EP | 0735273 | 10/1996 |
| EP | 0978657 | 2/2000 |
| FR | 2529965 | 6/1983 |
| FR | 2703409 | 10/1994 |
| JP | 5010270 | 1/1993 |
| WO | WO 98/04835 | 2/1998 |
| WO | WO 01/47099 | 6/2001 |
| WO | WO 2004/006416 | 1/2004 |
| WO | WO 2004/088694 | 10/2004 |
| WO | WO 2006/069568 | 7/2006 |

* cited by examiner

CONTROL ALGORITHM OF VARIABLE SPEED PUMPING SYSTEM

This application is a continuation-in-part of U.S. patent application Ser. No. 10/926,513 filed on Aug. 26, 2004 now U.S. Pat. No. 7,874,808.

FIELD OF THE INVENTION

The present invention relates generally to control of a pump, and more particularly to control of a variable speed pumping system for a pool, a spa or other aquatic application.

BACKGROUND OF THE INVENTION

Conventionally, a pump to be used in an aquatic application such as a pool or a spa is operable at a finite number of predetermined speed settings (e.g., typically high and low settings). Typically these speed settings correspond to the range of pumping demands of the pool or spa at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the pumping demands.

Installation of the pump for an aquatic application such as a pool entails sizing the pump to meet the pumping demands of that particular pool and any associated features. Because of the large variety of shapes and dimensions of pools that are available, precise hydraulic calculations must be performed by the installer, often on-site, to ensure that the pumping system works properly after installation. The hydraulic calculations must be performed based on the specific characteristics and features of the particular pool, and may include assumptions to simplify the calculations for a pool with a unique shape or feature. These assumptions can introduce a degree of error to the calculations that could result in the installation of an unsuitably sized pump. Essentially, the installer is required to install a customized pump system for each aquatic application.

A plurality of aquatic applications at one location requires a pump to elevate the pressure of water used in each application. When one aquatic application is installed subsequent to a first aquatic application, a second pump must be installed if the initially installed pump cannot be operated at a speed to accommodate both aquatic applications. Similarly, features added to an aquatic application that use water at a rate that exceeds the pumping capacity of an existing pump will need an additional pump to satisfy the demand for water. As an alternative, the initially installed pump can be replaced with a new pump that can accommodate the combined demands of the aquatic applications and features.

During use, it is possible that a conventional pump is manually adjusted to operate at one of the finite speed settings. Resistance to the flow of water at an intake of the pump causes a decrease in the volumetric pumping rate if the pump speed is not increased to overcome this resistance. Further, adjusting the pump to one of the settings may cause the pump to operate at a rate that exceeds a needed rate, while adjusting the pump to another setting may cause the pump to operate at a rate that provides an insufficient amount of flow and/or pressure. In such a case, the pump will either operate inefficiently or operate at a level below that which is desired.

Accordingly, it would be beneficial to provide a pump that could be readily and easily adapted to provide a suitably supply of water at a desired pressure to aquatic applications having a variety of sizes and features. The pump should be customizable on-site to meet the needs of the particular aquatic application and associated features, capable of pumping water to a plurality of aquatic applications and features, and should be variably adjustable over a range of operating speeds to pump the water as needed when conditions change. Further, the pump should be responsive to a change of conditions and/or user input instructions.

SUMMARY OF THE INVENTION

In accordance with one aspect, the present invention provides a pumping system for moving water of an aquatic application. The pumping system includes a water pump for moving water in connection with performance of an operation upon the water and a variable speed motor operatively connected to drive the pump. The system includes means for determining a value indicative of flow rate of water moved by the pump, and means for controlling the motor to adjust the flow rate indicative value toward a constant. The system includes means for determining a value indicative of flow pressure of water moved by the pump, and means for controlling the motor to adjust the flow pressure indicative value toward a constant. The system includes means for selecting between flow rate control and flow pressure control.

In accordance with another aspect, the present invention provides a pumping system for moving water of an aquatic application. The pumping system includes a water pump for moving water, and a variable speed motor operatively connected to drive the pump. The system includes means for controlling the motor to adjust motor output, means for performing a first operation upon the moving water, and means for performing a second operation upon the moving water. The system includes means for using control parameters for the motor during the first operation based upon a target water volume, and means for determining volume of water moved by the pump during a time period. The system also includes means for changing the control parameters used for the first operation dependent upon performance of the second operation during the time period.

In accordance with another aspect, the present invention provides a pumping system for moving water of an aquatic application. The pumping system includes a water pump for moving water in connection with performance of an operation upon the water and a variable speed motor operatively connected to drive the pump. The system includes means for determining flow rate of water moved by the pump, and means for controlling the motor to adjust the flow rate toward a constant flow rate value. The system includes means for determining flow pressure of water moved by the pump, and means for controlling the motor to adjust the flow pressure toward a constant flow pressure value. The system includes means for selecting between flow rate control and flow pressure control.

In accordance with yet another aspect, the present invention provides a pumping system for moving water of an aquatic application. The pumping system includes a water pump for moving water, and means for controlling operation of the pump to perform a first water operation with at least one predetermined parameter. The system includes means for operating the pump to perform a second water operation, and means for altering control of operation of the pump to perform the first water operation to vary the at least one parameter in response to operation of the pump to perform the second operation.

In accordance with yet another aspect, the present invention provides a pumping system for moving water of an aquatic application. The pumping system includes a water pump for moving water, and means for controlling a routine filter cycle. The system includes means for operating the pump to perform an additional water operation, and means for altering the routine filter cycle in response to operation of the pump to perform the additional water operation.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
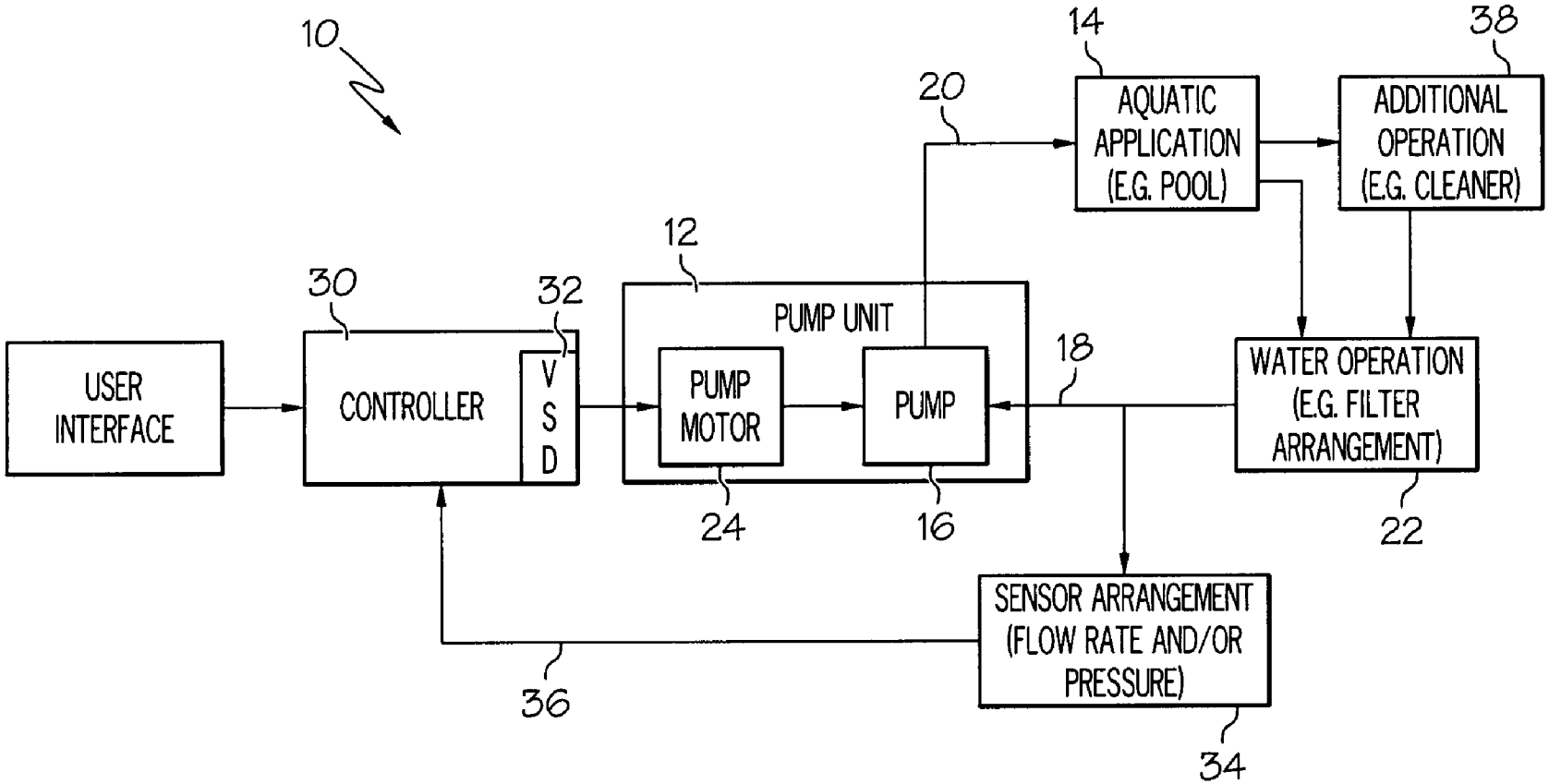
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a pool 14. It is to be appreciated that the pump unit 12 includes a pump 16 for moving water through inlet and outlet lines 18 and 20.

The pool 14 is one example of an aquatic application with which the present invention may be utilized. The phrase "aquatic application" is used generally herein to refer to any reservoir, tank, container or structure, natural or man-made, having a fluid, capable of holding a fluid, to which a fluid is delivered, or from which a fluid is withdrawn. Further, "aquatic application" encompasses any feature associated with the operation, use or maintenance of the aforementioned reservoir, tank, container or structure. This definition of "aquatic application" includes, but is not limited to pools, spas, whirlpool baths, landscaping ponds, water jets, waterfalls, fountains, pool filtration equipment, pool vacuums, spillways and the like. Although each of the examples provided above includes water, additional applications that include liquids other than water are also within the scope of the present invention. Herein, the terms pool and water are used with the understanding that they are not limitations on the present invention.

A water operation 22 is performed upon the water moved by the pump 16. Within the shown example, water operation 22 is a filter arrangement that is associated with the pumping system 10 and the pool 14 for providing a cleaning operation (i.e., filtering) on the water within the pool. The filter arrangement 22 is operatively connected between the pool 14 and the pump 16 at/along an inlet line 18 for the pump. Thus, the pump 16, the pool 14, the filter arrangement 22, and the interconnecting lines 18 and 20 form a fluid circuit or pathway for the movement of water.

It is to be appreciated that the function of filtering is but one example of an operation that can be performed upon the water. Other operations that can be performed upon the water may be simplistic, complex or diverse. For example, the operation performed on the water may merely be just movement of the water by the pumping system (e.g., re-circulation of the water in a waterfall or spa environment).

Turning to the filter arrangement 22, any suitable construction and configuration of the filter arrangement is possible. For example, the filter arrangement 22 may include a skimmer assembly for collecting coarse debris from water being withdrawn from the pool, and one or more filter components for straining finer material from the water.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor-operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is a three-phase motor. The pump motor 24 operation is infinitely variable within a range of operation (i.e., zero to maximum operation). In one specific example, the operation is indicated by the RPM of the rotational force provided to rotate the impeller of the pump 16.

A controller 30 provides for the control of the pump motor 24 and thus the control of the pump 16. Within the shown example, the controller 30 includes a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase DC current. Any suitable technique and associated construction/configuration may be used to provide the three-phase DC current. For example, the construction may include capacitors to correct line supply over or under voltages. The variable speed drive supplies the DC electric power at a changeable frequency to the pump motor to drive the pump motor. The construction and/or configuration of the pump 16, the pump motor 24, the controller 30 as a whole, and the variable speed drive 32 as a portion of the controller 30, are not limitations on the present invention. In one possibility, the pump 16 and the pump motor 24 are disposed within a single housing to form a single unit, and the controller 30 with the variable speed drive 32 are disposed within another single housing to form another single unit. In another possibility, these components are disposed within a single housing to form a single unit.

The pumping system 10 has means used for control of the operation of the pump. In accordance with one aspect of the present invention, the pumping system 10 includes means for sensing, determining, or the like one or more parameters indicative of the operation performed upon the water. Within one specific example, the system includes means for sensing, determining or the like one or more parameters indicative of the movement of water within the fluid circuit.

The ability to sense, determine or the like one or more parameters may take a variety of forms. For example, one or more sensors 34 may be utilized. Such one or more sensors 34 can be referred to as a sensor arrangement. The sensor arrangement 34 of the pumping system 10 would sense one or more parameters indicative of the operation performed upon the water. Within one specific example, the sensor arrangement 34 senses parameters indicative of the movement of water within the fluid circuit. The movement along the fluid circuit includes movement of water through the filter arrangement 22. As such, the sensor arrangement 34 includes at least one sensor used to determine flow rate of the water moving within the fluid circuit and/or includes at least one sensor used to determine flow pressure of the water moving within the fluid circuit. In one example, the sensor arrangement 34 is operatively connected with the water circuit at/adjacent to the location of the filter arrangement 22. It should be appreciated that the sensors of the sensor arrangement 34 may be at different locations than the locations presented for the example. Also, the sensors of the sensor arrangement 34 may be at different locations from each other. Still further, the sensors may be configured such that different sensor portions are at different locations within the fluid circuit. Such a sensor arrangement 34 would be operatively connected 36 to the controller 30 to provide the sensory information thereto.

It is to be noted that the sensor arrangement 34 may accomplish the sensing task via various methodologies, and/or different and/or additional sensors may be provided within the system 10 and information provided therefrom may be utilized within the system. For example, the sensor arrangement 34 may be provided that is associated with the filter arrangement and that senses an operation characteristic associated with the filter arrangement. For example, such a sensor may monitor filter performance. Such monitoring may be as basic as monitoring filter flow rate, filter pressure, or some other parameter that indicates performance of the filter arrangement. Of course, it is to be appreciated that the sensed parameter of operation may be otherwise associated with the operation performed upon the water. As such, the sensed parameter of operation can be as simplistic as a flow indicative parameter such as rate, pressure, etc.

Such indication information can be used by the controller 30, via performance of a program, algorithm or the like, to perform various functions, and examples of such are set forth below. Also, it is to be appreciated that additional functions and features may be separate or combined, and that sensor information may be obtained by one or more sensors.

With regard to the specific example of monitoring flow rate and flow pressure, the information from the sensor arrangement 34 can be used as an indication of impediment or hindrance via obstruction or condition, whether physical, chemical, or mechanical in nature, that interferes with the flow of water from the aquatic application to the pump such as debris accumulation or the lack of accumulation, within the filter arrangement 34. As such, the monitored information is indicative of the condition of the filter arrangement.

Within another example (FIG. 2) of a pumping system 110 that includes means for sensing, determining, or the like one or more parameters indicative of the operation performed upon the water, the controller 130 can determine the one or more parameters via sensing, determining or the like parameters associated with the operation of a pump 116 of a pump unit 112. Such an approach is based upon an understanding that the pump operation itself has one or more relationships to the operation performed upon the water.

It should be appreciated that the pump unit 112, which includes the pump 116 and a pump motor 124, a pool 114, a filter arrangement 122, and interconnecting lines 118 and 120, may be identical or different from the corresponding items within the example of FIG. 1.

Figure 2:
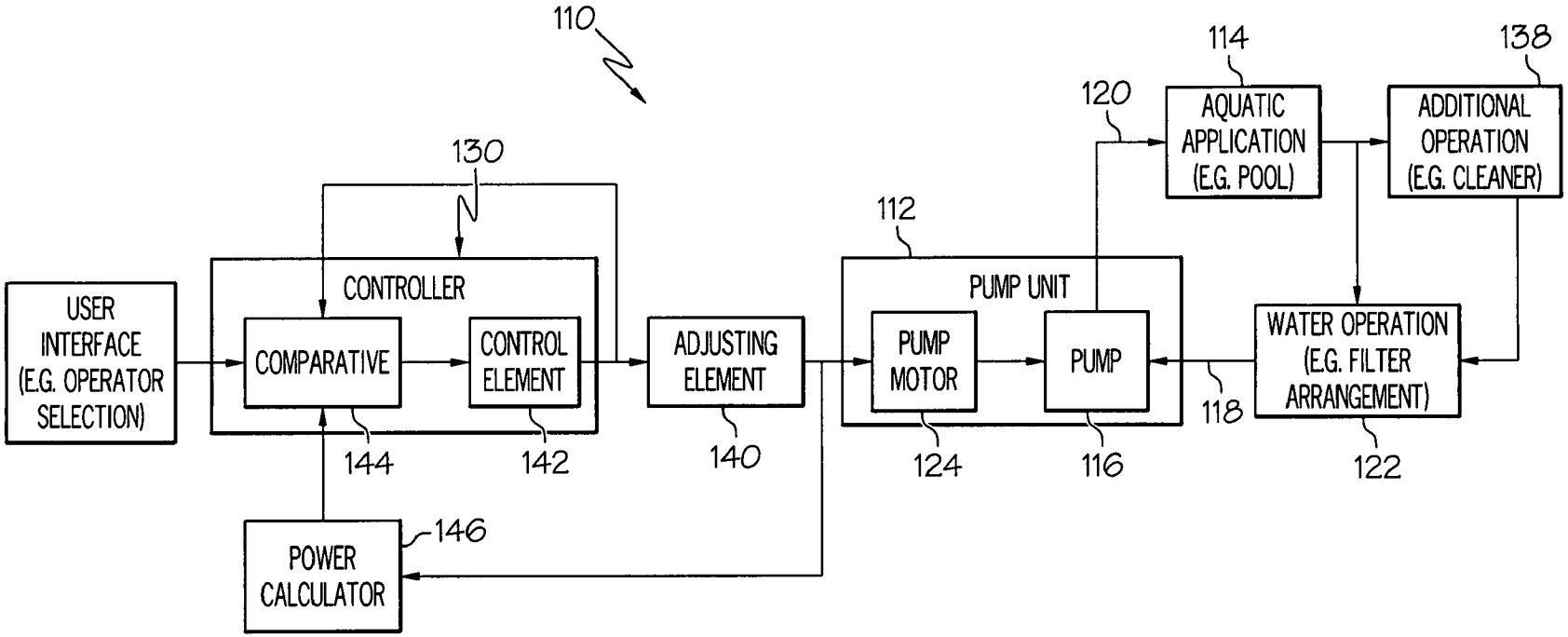
FIG. 2 is another block diagram of another example of a variable speed pumping system in accordance with the present invention with a pool environment.

Turning back to the example of FIG. 2, some examples of the pumping system 110, and specifically the controller 130 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference. In short summary, direct sensing of the pressure and/or flow rate of the water is not performed, but instead one or more sensed or determined parameters associated with pump operation are utilized as an indication of pump performance. One example of such a pump parameter is input power. Pressure and/or flow rate can be calculated/determined from such pump parameter(s).

Although the system 110 and the controller 130 there may be of varied construction, configuration and operation, the function block diagram of FIG. 2 is generally representative. Within the shown example, an adjusting element 140 is operatively connected to the pump motor and is also operatively connected to a control element 142 within the controller 130. The control element 142 operates in response to a comparative function 144, which receives input from a power calculation 146.

The power calculation 146 is performed utilizing information from the operation of the pump motor 124 and controlled by the adjusting element 140. As such, a feedback iteration is performed to control the pump motor 124. Also, it is the operation of the pump motor and the pump that provides the information used to control the pump motor/pump. As mentioned, it is an understanding that operation of the pump motor/pump has a relationship to the flow rate and/or pressure of the water flow that is utilized to control flow rate and/or flow pressure via control of the pump.

As mentioned, the sensed, determined (e.g., calculated, provided via a look-up table, etc.), etc. information is utilized to determine the flow rate and/or the flow pressure. In one example, the operation is based upon an approach in which the pump (e.g., 16 or 116) is controlled to operate at a lowest amount that will accomplish the desired task (e.g., maintain a desired filtering level of operation) via a constant flow rate. Specifically, as the sensed parameter changes, the lowest level of pump operation (i.e., pump speed) to accomplish the desired task will need to change. The controller (e.g., 30 or 130) provides the control to operate the pump motor/pump accordingly. In other words, the controller (e.g., 30 or 130) repeatedly adjusts the speed of the pump motor (e.g., 24 or 124) to a minimum level responsive to the sensed/determined parameter to maintain operation at a specific level. Such an operation mode can provide for minimal energy usage.

Turning to the issue of operation of the system (e.g., 10 or 110) over a course of a long period of time, it is typical that a predetermined volume of water flow is desired. For example, it may be desirable to move a volume of water equal to the volume within the aquatic application (e.g., pool or spa). Such movement of water is typically referred to as a turnover. It may be desirable to move a volume of water equal to multiple turnovers within a specified time period (e.g., a day). Within an example in which the water operation includes a filter operation, the desired water movement (e.g., specific number of turnovers within one day) may be related to the necessity to maintain a desired water clarity.

Within the water operation that contains a filter operation, the amount of water that can be moved and/or the ease by which the water can be moved is dependent in part upon the current state (e.g., quality) of the filter arrangement. In general, a dean (e.g., new, fresh) filter arrangement provides a lesser impediment to water flow than a filter arrangement that has accumulated filter matter (e.g., dirty). For a constant flow rate through a filter arrangement, a lesser pressure is required to move the water through a clean filter arrangement than a pressure that is required to move the water through a dirty filter arrangement. Another way of considering the effect of dirt accumulation is that if pressure is kept constant then the flow rate will decrease as the dirt accumulates and hinders (e.g., progressively blocks) the flow.

Turning to one aspect that is provided by the present invention, the system can operate to maintain a constant flow of water within the circuit. Maintenance of constant flow is useful in the example that includes a filter arrangement. Moreover, the ability to maintain a constant flow is useful when it is desirable to achieve a specific flow volume during a specific period of time. For example, it may be desirable to filter pool water and achieve a specific number of water turnovers within each day of operation to maintain a desired water clarity despite the fact that the filter arrangement will progressively increase dirt accumulation.

It should be appreciated that maintenance of a constant flow volume despite an increasing impediment caused by filter dirt accumulation requires an increasing pressure and is the result of increasing motive force from the pump/motor. As such, one aspect of the present invention is to control the motor/pump to provide the increased motive force that provides the increased pressure to maintain the constant flow.

Of course, continuous pressure increase to address the increase in filter dirt impediment is not useful beyond some level. As such, in accordance with another aspect of the present invention, the system (e.g., 10 or 110) controls operation of the motor/pump such that the motive force is not increased and the flow rate is thus not maintained constant. In one example, the cessation of increases in motive force occurs once a specific pressure level (e.g., a threshold) is reached. A pressure level threshold may be related to a specific filter type, system configuration, etc. In one specific example, the specific pressure level threshold is predetermined. Also, within one specific example, the specific pressure level threshold may be a user or technician-entered parameter.

Within another aspect of the present invention, the system (e.g., 10 or 110) may operate to reduce pressure while the pressure is above the pressure level threshold. Within yet another, related aspect of the present invention, the system (e.g., 10 or 110) may return to control of the flow rate to maintain a specific, constant flow rate subsequent to the pressure being reduced below the pressure level threshold.

Within yet another aspect of the present invention, the system (e.g., 10 or 110) may operate to have different constant flow rates during different time periods. Such different time periods may be sub-periods (e.g., specific hours) within an overall time period (e.g., a day) within which a specific number of water turnovers is desired. During some time periods a larger flow rate may be desired, and a lower flow rate may be desired at other time periods. Within the example of a swimming pool with a filter arrangement as part of the water operation, it may be desired to have a larger flow rate during pool-use time (e.g., daylight hours) to provide for increased water turnover and thus increased filtering of the water. Within the same swimming pool example, it may be desired to have a lower flow rate during non-use (e.g., nighttime hours).

Figure 3:
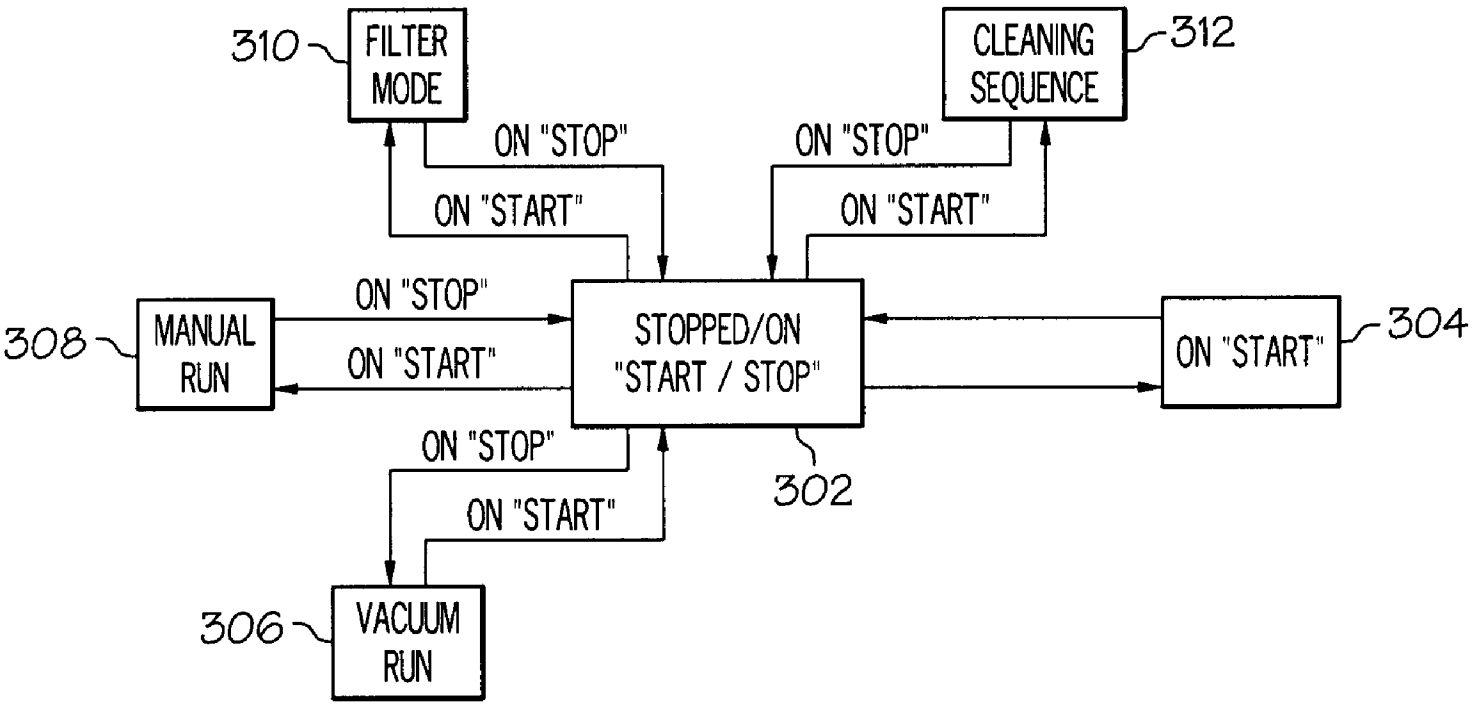
FIG. 3 is a function flow chart for an example methodology in accordance with the present invention.

Turning to one specific example, attention is directed to the top-level operation chart that is shown in FIG. 3. With the chart, it can be appreciated that the system has an overall ON/OFF status 302 as indicated by the central box. Specifically, overall operation is started 304 and thus the system is ON. However, under the penumbra of a general ON state, a number of modes of operation can be entered. Within the shown example, the modes are Vacuum run 306, Manual run 308, Filter 310, and Cleaning sequence 312.

Briefly, the Vacuum run mode 306 is entered and utilized when a vacuum device is utilized within the pool (e.g., 14 or 114). For example, such a vacuum device is typically connected to the pump (e.g., 16 or 116), possibly through the filter arrangement, (e.g., 22 or 122) via a relative long extent of hose and is moved about the pool (e.g., 14 or 114) to clean the water at various locations and/or the surfaces of the pool at various locations. The vacuum device may be a manually moved device or may autonomously move.

Similarly, the manual run mode 308 is entered and utilized when it is desired to operate the pump outside of the other specified modes. The cleaning sequence mode 312 is for operation performed in the course of a cleaning routine.

Turning to the filter mode 310, this mode is a typical operation mode in order to maintain water clarity within the pool (e.g., 14 or 114). Moreover, the filter mode 310 is operated to obtain effective filtering of the pool while minimizing energy consumption. As one example of the filter mode 310, attention is directed to the flow chart of FIG. 4 that shows an example process 400 for accomplishing a filter function within the filter mode. Specifically, the pump is operated to move water through the filter arrangement. It is noted that the example process is associated with the example of FIG. 2. However, it is to be appreciated that a similar process occurs associated with the example of FIG. 1.

The process 400 (FIG. 4) is initiated at step 402 and proceeds to step 404. At step 404 information is retrieved from a filter menu. The information may take a variety of forms and may have a variety of contents. As one example, the information includes cycles of circulation of the water per day, turnovers per day, scheduled time (e.g., start and stop times for a plurality of cycles), pool size, filter pressure before achieving a service systems soon status, and maximum priming time. It should be appreciated that such information (e.g., values) is desired and/or intended, and/or preselected/predetermined.

Subsequent to step 404, the process 400 proceeds to step 406 in which one or more calculations are performed. For example, a filter flow value is determined based upon a ratio of pool size to scheduled time (e.g., filter flow equals pool size divided by scheduled time). Also, the new off time may be calculated for the scheduled time (e.g., a cut off time). Next, the process 400 proceeds to step 408 in which a "START" is activated to begin repetitive operation of the filter mode.

The process 400 proceeds from step 408 to step 410 in which it is determined whether the flow is above a priming flow value. If the determination at step 410 is negative (e.g., the flow is not above a priming flow value), the process 400 proceeds to step 412. Within step 412, the flow control process is performed. As mentioned above, the flow control process may be similar to the process disclosed within U.S. Pat. No. 6,354,805 or U.S. Pat. No. 6,468,042. It should be noted that step 414 provides input that is utilized within step 412. Specifically, hardware input such as power and speed measurement are provided. This information is provided via a hardware input that can give information in a form of current and/or voltage as an indication of power and speed measurement of the pump motor. Associated with step 414 is step 416 in which shaft power provided by the pump motor is calculated. At step 418, a priming dry alarm step is provided. In one example, if the shaft power is zero for ten seconds, a priming dry alarm is displayed and the process 400 is interrupted and does not proceed any further until the situation is otherwise corrected.

Returning to step 412, it should be appreciated that subsequent to operation of the step 412, the process 400 returns to step 410 in which the query concerning the flow being above a priming flow is repeated. If the determination within step 410 is affirmative (i.e., the flow is above the priming flow value), the process 400 proceeds from step 410 to step 420.

It should be appreciated that steps 408 and 420 provide two bits of information that is utilized within an ancillary step 421. Specifically, step 408 provides a time start indication and step 420 provides a time primed indication. Within step 421, a determination concerning a priming alarm is made. Specifically, if priming control (i.e., the system is determined to be primed), is not reached prior to a maximum priming time allotment, a priming alarm is displayed, and the process 400 is interrupted and does not proceed any further until the situation is addressed and corrected.

Returning to step 420, the process 400 proceeds from step 420 to step 422 in which a flow reference is set equal to the current filter flow value. Subsequent to step 422, the process 400 proceeds to step 424. At step 424, it is determined whether the system is operating at a specified flow reference. The filter flow is defined in terms of volume based upon time. If the determination at step 424 is negative (i.e., the system is not operating at the flow reference level), the process 400 proceeds to step 426. At step 426, the flow control process is performed, similar to step 412. As such, step 414 also provides input that is utilized within step 426. Subsequent to step 426, the process returns to step 424.

If the determination with step 424 is affirmative (i.e., the system is operating at the flow reference level), the process 400 proceeds to step 428 in which pressure is calculated. Pressure can be calculated based upon information derived from operation of the pump. Subsequent to step 428, the process 400 proceeds to step 430. At 430, a determination is made as to whether the pressure is above a maximum filter pressure.

It should be noted that step 432 of the process 400 provides input to the determination within the step 430. Specifically, at step 432 a menu of data that contains a maximum filter pressure value is accessed. If the determination at step 430, is negative (i.e., the pressure is not above the maximum filter pressure), the process 400 proceeds to step 434. At step 434, the filter status is updated in the menu memory. Subsequent to step 434, the process 400 proceeds to step 436.

At step 436, a determination is made as to whether the flow reference is equal to the filter flow. If the determination as step 436 is affirmative (i.e., the flow reference is equal to the filter flow), the process 400 loops back to step 422. However, if the determination at step 436 is negative (i.e., the flow reference is not equal to the filter flow), the process 400 proceeds to steps 438 and 440.

Within step 438, a determination is made as to whether the filter status is higher than 100%. If so, a service system soon indication is displayed. At step 440, a flow reference at reference N is readjusted to equal a previous flow reference (i.e., N−1 plus a specific value). Within the shown example, the additional value is 1 gallon per minute. Subsequent to the adjustment of the flow reference, the process 400 proceeds to step 428 for repeat of step 428 and at least some of the subsequent process steps.

Focusing again upon step 430, if the determination at step 430 is affirmative (i.e., the pressure is above the maximum filter pressure), the process 400 proceeds from step 430 to step 442. At step 442, the process 400 changes from flow control to pressure control. Specifically, it is to be appreciated that up to this time, the process 400 has attempted to maintain the flow rate at an effectively constant value. However, from step 442, the process 400 will attempt to maintain the flow pressure at effectively a constant value.

The process 400 proceeds from step 442 to step 444. Within step 444, a flow reference value is adjusted. Specifically, the flow reference value for time index N is set equal to the flow reference value for time index N−1 that has been decreased by a predetermined value. Within this specific example, the decreased value is 1 gallon per minute. Subsequent to step 444, the process 400 proceeds to step 446 in which the flow controller, as previously described, performs its function. Similar to the steps 412 and 426, step 446 obtains hardware input. For example, power and speed measuring information is provided for use within the flow controller. Subsequent to step 446, the process 400 proceeds to step 448.

Within the step 448 a determination is made as to whether the flow equals a flow reference. If the determination within step 448 is negative (i.e., the flow does not equal the flow reference), the process 400 proceeds from step 448 back to step 446. However, if the determination within step 448 is affirmative (i.e., the flow is equal to the flow reference), the process 400 proceeds from step 448 to step 450. Within step 450, the status of filter arrangement is updated within the memory of the menu. Subsequent to step 450, the process 400 proceeds back to step 428 and at least some of the subsequent steps are repeated.

Figure 4A:
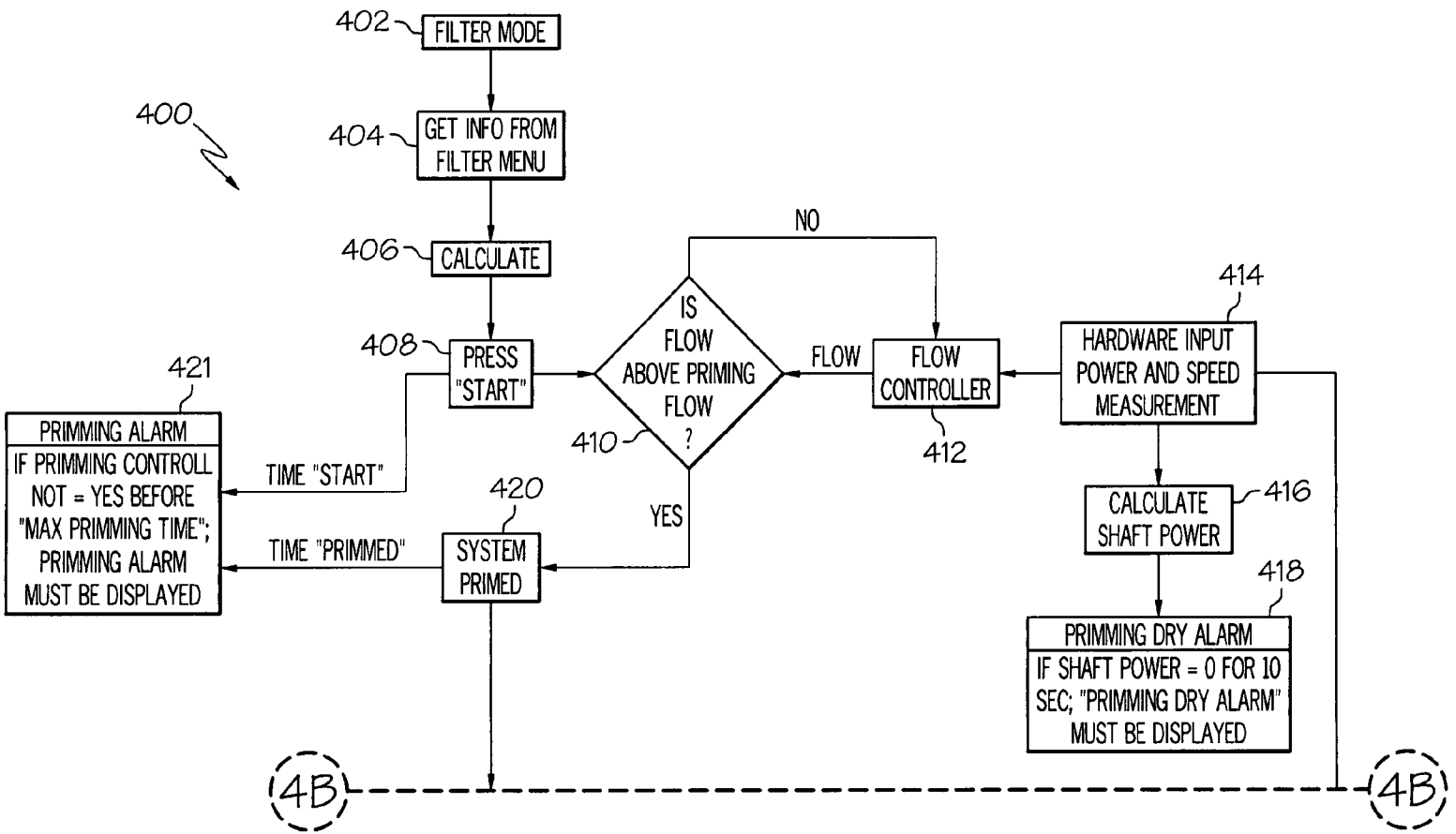
FIGS. 4A and 4B are a flow chart for an example of a process in accordance with an aspect of the present invention.
Figure 4B:
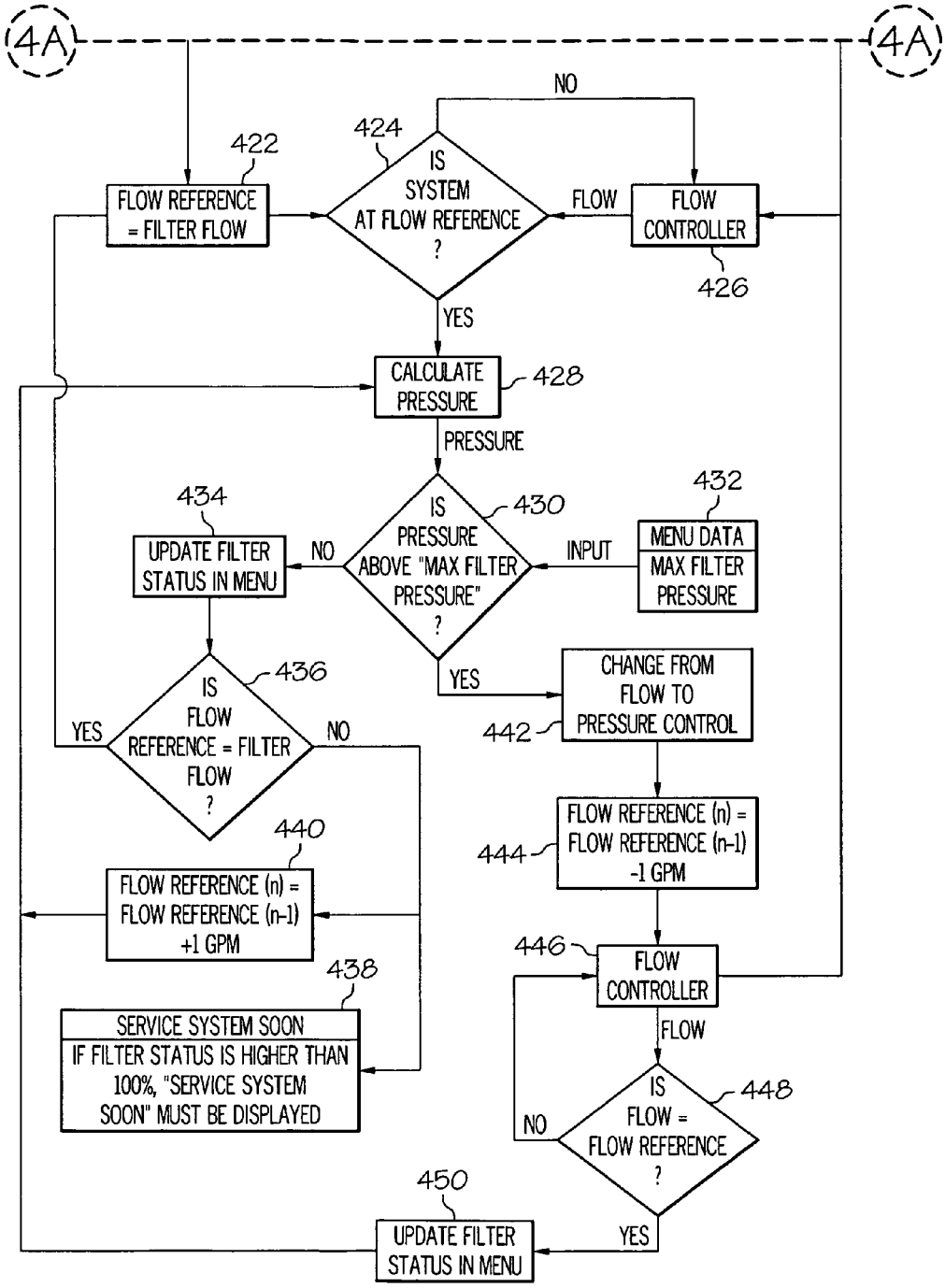

One of the advantages provided by the example shown within FIG. 4 is that a minimum amount of energy is extended to maintain a constant flow so long as the filter arrangement does not provide an excessive impediment to flow of water. However, subsequent to the filter arrangement becoming a problem to constant flow (e.g., the filter arrangement is sufficiently clogged), the methodology provides for a constant pressure to be maintained to provide for at least some filtering function despite an associated decrease in flow. Moreover, the process is iterative to constantly adjust the flow or the pressure to maintain a high efficiency coupled with a minimal energy usage.

In accordance with another aspect, it should be appreciated that the filtering function, as a free standing operation, is intended to maintain clarity of the pool water. However, it should be appreciated that the pump (e.g., 16 or 116) may also be utilized to operate other functions and devices such as a separate cleaner, a water slide, or the like. The example of FIG. 1 shows an example additional operation 38 and the example of FIG. 2 shows an example additional operation 138. Such an additional operation (e.g., 38 or 138) may be a cleaner device, either manual or autonomous. As can be appreciated, an additional operation involves additional water movement. Also, within the presented examples of FIGS. 1 and 2, the water movement is through the filter arrangement (e.g., 22 or 122). Such, additional water movement may be used to supplant the need for other water movement, in accordance with one aspect of the present invention and as described further below.

Associated with such other functions and devices is a certain amount of water movement. The present invention, in accordance with one aspect, is based upon an appreciation that such other water movement may be considered as part of the overall desired water movement, cycles, turnover, filtering, etc. As such, water movement associated with such other functions and devices can be utilized as part of the overall water movement to achieve desired values within a specified time frame. Utilizing such water movement can allow for minimization of a purely filtering aspect. This permits increased energy efficiency by avoiding unnecessary pump operation.

Figure 5A:
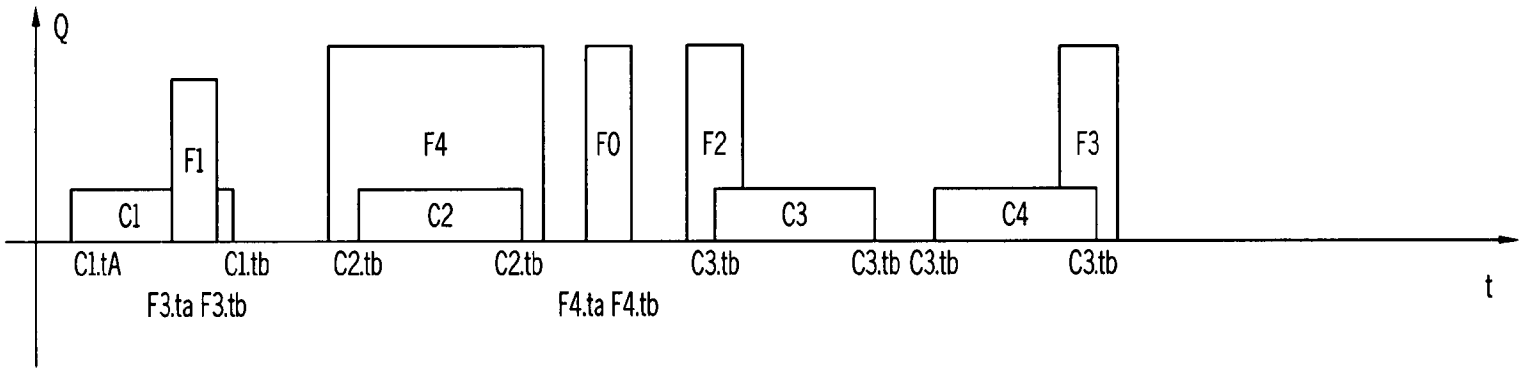
FIGS. 5A-5C are time lines showing operations that may be performed via a system in accordance with the present.

FIG. 5A is an example time line that shows a typical operation that includes both filter cycles (C1-C4) and several various other operations and/or devices (F0-F4) that are operated. It should be appreciated that pump operation for all of these cycles, functions, and devices would be somewhat wasteful. As such, the present invention provides a means to reduce a routine filtration cycle (e.g., C1-C4) in response to occurrence of one or more operations (e.g., F0-F4). Below are a series of equations that check for overlap and cutoff based upon utilization of all of the features (routine filtration cycles, C1-C4, and all other operations, F0-F4).

Figure 5B:
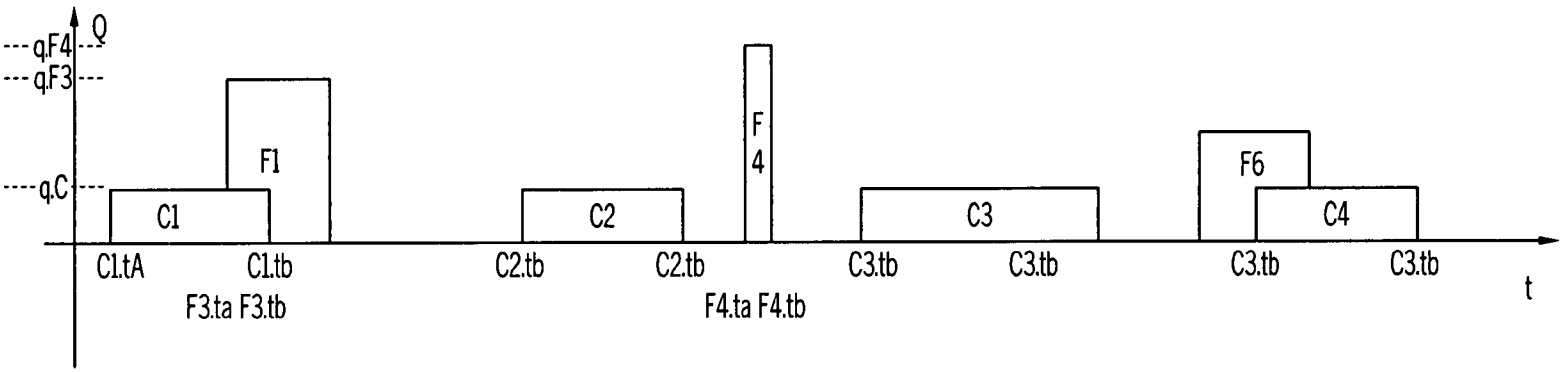

Overlap check and "cutoff" calculations for features for: all F's and C's case F0 type: (Fx.start<Cx.start & Fx.stop<Cx.start)|(Fx.start>Cx.stop & Fx.stop>Cx.stop)
  cutOff+=0 case F1 type: Fx.start>Cx.start & Fx.stop<Cx.stop
  cutOff+=Fx.stop−Fx.start case F2 type: Fx.start<Cx.start & Fx.stop<Cx.stop & Fx.stop>Cx.start
  cutOff+=Fx.stop−Cx.start case F3 type: Fx.start>Cx.start & Fx.start<Cx.stop & Fx.stop>Cx.stop
  cutOff+=Cx.stop−Fx.start case F4 type: Fx.start<Cx.start & Fx.stop>Cx.stop
  cutOff+=Cx.stop−Cx.start An example of how the routine filtration cycles are reduced is shown via a comparison of FIGS. 5B and 5C. Specifically, FIG. 5B shows the cycles for routine filtration (C1-C2) and three other pump operation routines (e.g., F3, F4, and F6). As to be appreciated, because the other operations (F3, F4, and F6) will provide some of the necessary water movement, the routine filtration cycles can be reduced or otherwise eliminated. The equations set forth below provide an indication of how the routine filtration cycles can be reduced or eliminated.

```
k=q x t , konst = flow × time
For (all F's with k>0){
        krestF = k
        for (all C's)
  if FTstart > CTstart & FTstart < CTstop)
        krestF + kF − k(CTb − Fta)
else
        if (krestF < krestC)
        krestC = krestC − krestF
        CTstop = CTstart + (krestC/qC)
```

-continued $$Cq = \frac{Ck}{CTstop - CTstart}$$

```
else
        krestF = krestF − krestC
        delete C
```

Figure 5C:
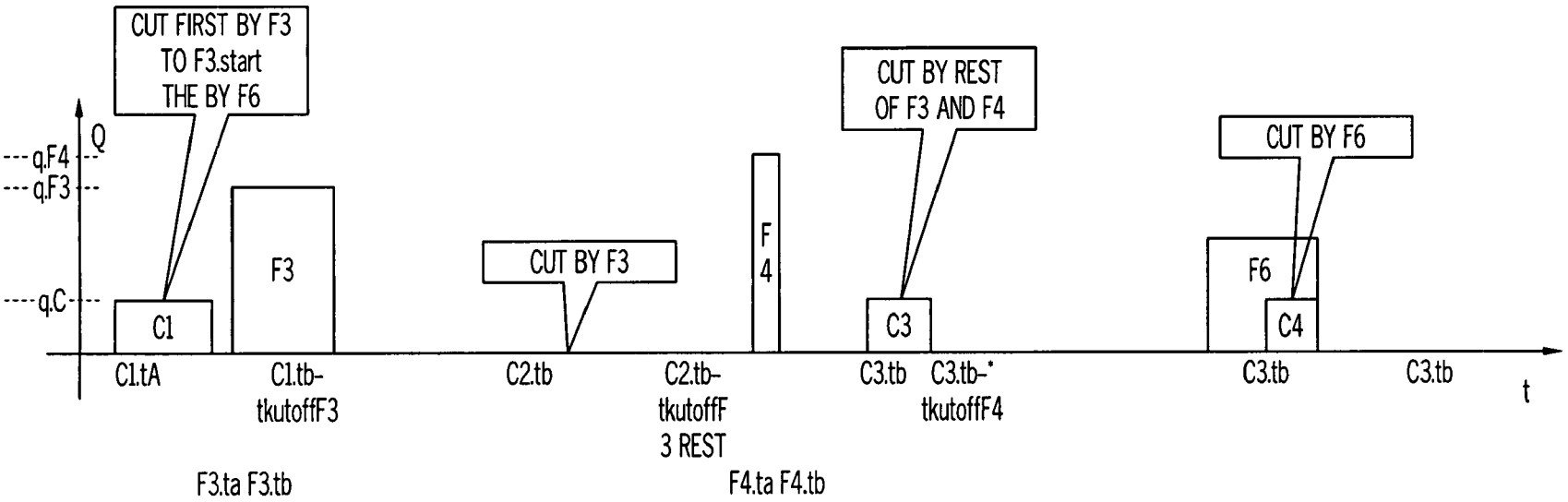

FIG. 5C shows how the routine filtration cycles C1-C4 are reduced or eliminated. It should be appreciated that the other functions (F3, F4, and F6 remain).

Focusing on the aspect of minimal energy usage, within some know pool filtering applications, it is common to operate a known pump/filter arrangement for some portion (e.g., eight hours) of a day at effectively a very high speed to accomplish a desired level of pool cleaning. With the present invention, the system (e.g., 10 or 110) with the associated filter arrangement (e.g., 22 or 122) can be operated continuously (e.g., 24 hours a day, or some other time amount(s)) at an ever-changing minimum level to accomplish the desired level of pool cleaning. It is possible to achieve a very significant savings in energy usage with such a use of the present invention as compared to the known pump operation at the high speed. In one example, the cost savings would be in the range of 90% as compared to a known pump/filter arrangement.

Accordingly, one aspect of the present invention is that the pumping system controls operation of the pump to perform a first water operation with at least one predetermined parameter. The first operation can be routine filtering and the parameter may be timing and or water volume movement (e.g., flow rate or pressure). The pump can also be operated to perform a second water operation, which can be anything else besides just routine filtering (e.g., cleaning). However, in order to provide for energy conservation, the first operation (e.g., just filtering) is controlled in response to performance of the second operation (e.g., running a cleaner).

Aquatic applications will have a variety of different water demands depending upon the specific attributes of each aquatic application. Turning back to the aspect of the pump that is driven by the infinitely variable motor, it should be appreciated that precise sizing, adjustment, etc. for each application of the pump system for an aquatic application can thus be avoided. In many respects, the pump system is self adjusting to each application.

It is to be appreciated that the controller (e.g., 30 or 130) may have various forms to accomplish the desired functions. In one example, the controller 30 includes a computer processor that operates a program. In the alternative, the program may be considered to be an algorithm. The program may be in the form of macros. Further, the program may be changeable, and the controller 30 is thus programable.

Figure 6:
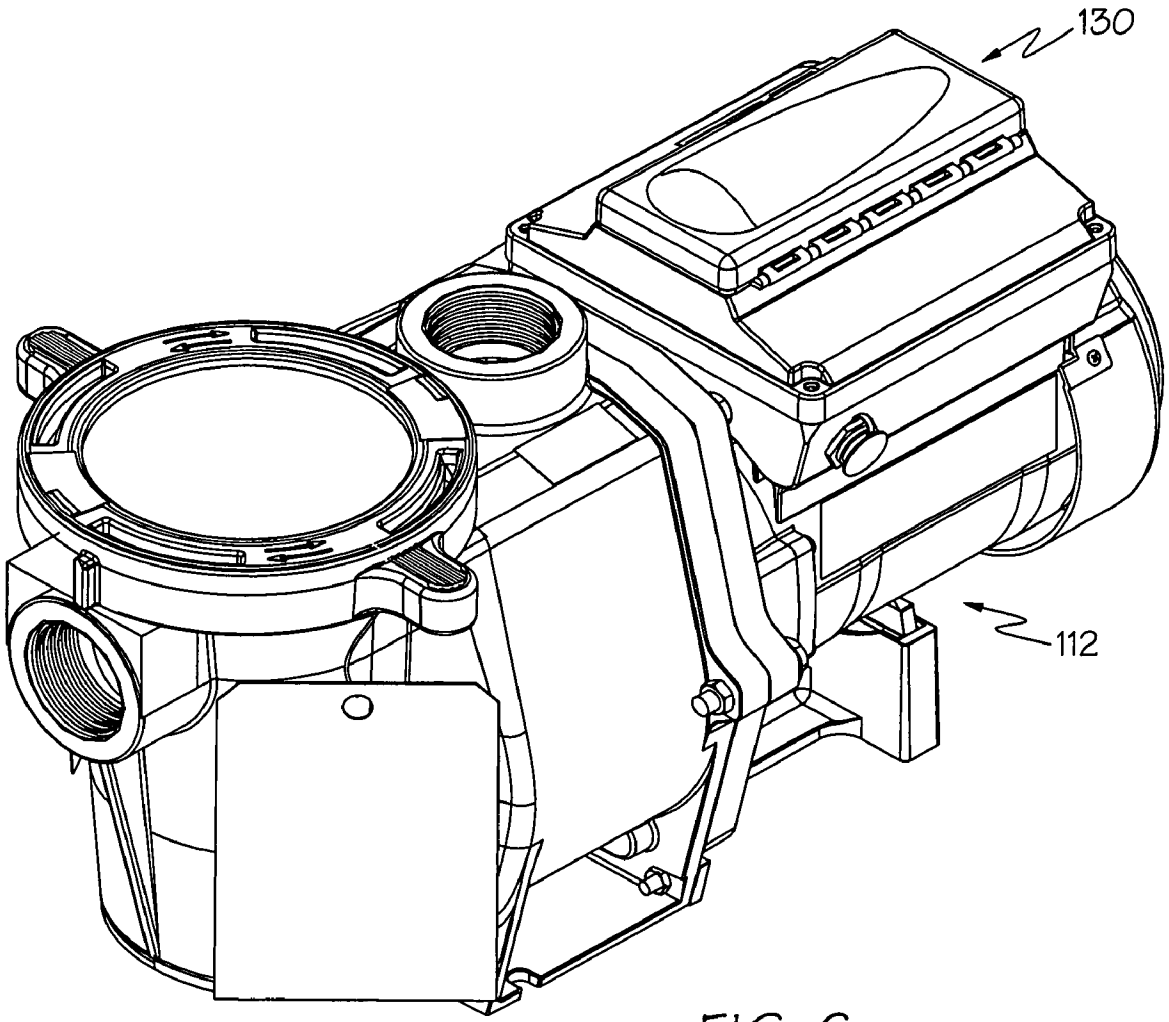
FIG. 6 is a perceptive view of an example pump unit that incorporates the present invention.
Figure 7:
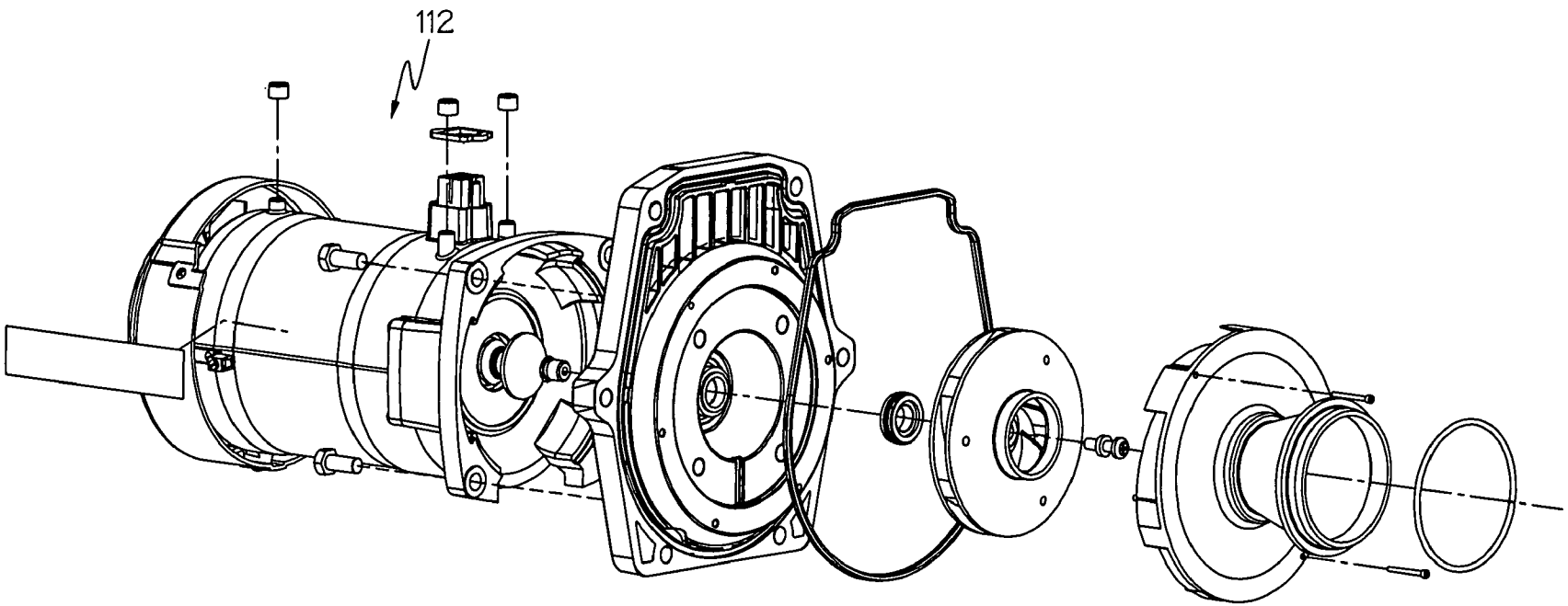
FIG. 7 is a perspective, partially exploded view of a pump of the unit shown in FIG. 6.
Figure 8:
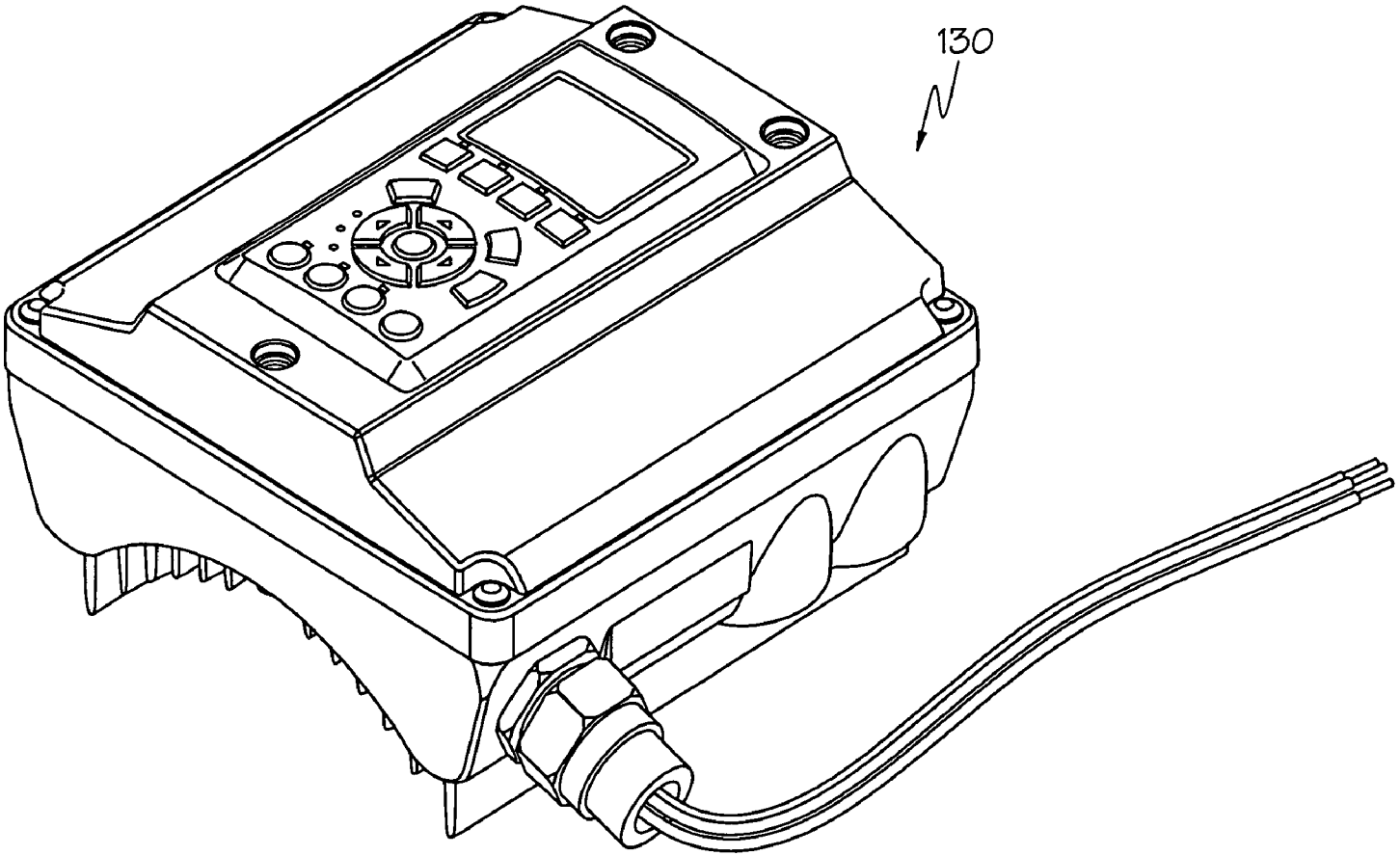
FIG. 8 is a perspective view of a controller unit of the pump unit shown in FIG. 6.

Also, it is to be appreciated that the physical appearance of the components of the system (e.g., 10 or 110) may vary. As some examples of the components, attention is directed to FIGS. 6-8. FIG. 6 is a perspective view of the pump unit 112 and the controller 130 for the system 110 shown in FIG. 2. FIG. 7 is an exploded perspective view of some of the components of the pump unit 112. FIG. 8 is a perspective view of the controller 130.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

What is claimed is:

1. A pumping system for at least one aquatic application, the pumping system comprising:

a pump;

a motor coupled to the pump;

a filter coupled to the pump; and a controller in communication with the motor, the controller making a sensorless determination of a current value of at least one of pressure and flow rate based only on an input power to the motor, the controller using feedback to maintain the flow rate at a substantially constant value despite an increasing impediment caused by debris accumulating in the filter.

2. The pumping system of claim 1, wherein the controller uses feedback to maintain the flow rate at the substantially constant value by increasing the pressure until the pressure reaches a maximum filter pressure.

3. The pumping system of claim 2, wherein the controller uses feedback to maintain the pressure at a substantially constant value with a decreased flow rate after the pressure reaches the maximum filter pressure.

4. The pumping system of claim 1, wherein the pressure is used to calculate a percentage of filter status.

5. The pumping system of claim 4, wherein the controller generates a filter alarm and stops the pumping system when the percentage of filter status is about 100 percent.

6. The pumping system of claim 4, wherein a backwash cycle is performed to reset the filter status.

7. The pumping system of claim 1, wherein the controller obtains the input power from a hardware input in the form of at least one of a voltage and a current.

8. A pumping system for at least one aquatic application receiving inputs from a user, the pumping system comprising:

a pump;

a motor coupled to the pump;

a filter coupled to the pump; and a controller in communication with the motor, the controller obtaining from a filter menu a total size of the at least one aquatic application as input by the user and a scheduled time including start and stop times for at least one cycle as input by the user, the controller calculating a filter flow value by dividing the total size by the scheduled time in order to self-adjust to any total size of the at least one aquatic application.

9. The pumping system of claim 8, wherein the controller obtains from a filter menu at least one of cycles of circulation per day and turnovers per day in order to calculate the filter flow value.

10. The pumping system of claim 8, wherein filter flow value includes different flow rates for different time periods of a day.

11. The pumping system of claim 8, wherein the controller substantially continuously adjusts a speed of the motor to maintain an actual flow rate corresponding to the filter flow value.

12. A pumping system for at least one aquatic application, the pumping system comprising:

a pump;

a motor coupled to the pump; and a controller in communication with the motor, the controller determining a current flow rate based on an input power to the motor, the controller determining whether the current flow rate is above a priming flow value in order to determine whether the pumping system is primed, the controller indicating a priming alarm if the pumping system is not primed before reaching a maximum priming time allotment.

13. A pumping system for at least one aquatic application, the pumping system comprising:

a pump;

a motor coupled to the pump; and a controller in communication with the motor, the controller obtaining a hardware input including at least one of input power and motor speed, the controller calculating shaft power based on the hardware input, the controller determining priming status based on the shaft power, the controller indicating a priming dry alarm if the shaft power is at least approaching zero for at least about ten seconds.

14. A pumping system for at least one aquatic application, the pumping system comprising:

a pump;

a filter coupled to the pump;

a motor coupled to the pump; and a controller in communication with the motor, the controller performing routine filtration cycles, the controller automatically at least one of reducing and eliminating at least one of the routine filtration cycles when other operations provide additional water movement to achieve a desired turnover rate.

15. The pumping system of claim 14, wherein the other operations include at least one of a cleaning operation and a secondary filter operation.

16. The pumping system of claim 14, wherein the routine filtration cycles are controlled in response to performance of the other operations.

* * * * *